US007477755B2

(12) United States Patent
Saiki et al.

(10) Patent No.: US 7,477,755 B2
(45) Date of Patent: Jan. 13, 2009

(54) SPEAKER SYSTEM

(75) Inventors: Shuji Saiki, Nara (JP); Mitsukazu Kuze, Osaka (JP); Toshiyuki Matsumura, Osaka (JP); Sawako Kano, Hyogo (JP)

(73) Assignee: Panasonic Corporation, Osaka (JP)

( * ) Notice: Subject to any disclaimer, the term of this patent is extended or adjusted under 35 U.S.C. 154(b) by 265 days.

(21) Appl. No.: 10/583,323

(22) PCT Filed: Mar. 23, 2005

(86) PCT No.: PCT/JP2005/005259

§ 371 (c)(1),
(2), (4) Date: Jun. 16, 2006

(87) PCT Pub. No.: WO2005/101896

PCT Pub. Date: Oct. 27, 2005

(65) Prior Publication Data

US 2007/0127760 A1 Jun. 7, 2007

(30) Foreign Application Priority Data

Apr. 13, 2004 (JP) ..... 2004-117589

(51) Int. Cl.
*H04R 1/02* (2006.01)
*H04R 1/20* (2006.01)

(52) U.S. Cl. ..... 381/349; 381/345; 381/348; 381/351

(58) Field of Classification Search ..... 381/345, 381/349, 350, 353, 354, 351
See application file for complete search history.

(56) References Cited

U.S. PATENT DOCUMENTS 3,727,719 A * 4/1973 Yando ..... 381/349
3,780,824 A * 12/1973 Prince ..... 181/144
4,618,025 A * 10/1986 Sherman ..... 181/148
4,657,108 A * 4/1987 Ward ..... 181/151

(Continued)

FOREIGN PATENT DOCUMENTS

JP 54-40118 3/1979

(Continued)

OTHER PUBLICATIONS

Clarke, Thomas L.; "The augmented passive radiator: A workable speaker system"; May 1979; Journal of the Acoustical Society of America; 65(6); pp. 1340-1341.*

*Primary Examiner*—Suhan Ni
*Assistant Examiner*—Ryan C Robinson
(74) *Attorney, Agent, or Firm*—Wenderoth, Lind & Ponack, L.L.P.

(57) ABSTRACT

A speaker system according to the present invention comprises a cabinet (10), a speaker unit (11), a first parting board (12), a drone cone (13), an adsorption member (14), a second parting board (15), a backboard (16), a variable mechanism (17), and a port (18). A sound pressure generated by the speaker unit (11) causes a pressure variation in a second chamber (R12) via the drone cone (13). The adsorption member (14) with an effect of physical adsorption is operable to suppress the pressure variation. Furthermore, by displacing the diaphragm (171), the variable mechanism (17) is operable to reduce a pressure variation of a direct current component, which is caused by variations in ambient temperature or atmospheric pressure of the speaker system.

12 Claims, 9 Drawing Sheets

U.S. PATENT DOCUMENTS

| | | | | |
|---|---|---|---|---|
| 6,389,146 | B1 * | 5/2002 | Croft, III | 381/345 |
| 2004/0251077 | A1 * | 12/2004 | Wright et al. | 181/151 |

FOREIGN PATENT DOCUMENTS

| | | |
|---|---|---|
| JP | 55-143894 | 11/1980 |
| JP | 57-210798 | 12/1982 |
| JP | 60-500645 | 5/1985 |
| JP | 2-891 | 1/1990 |
| JP | 3-120195 | 12/1991 |
| JP | 2000-50384 | 2/2000 |

* cited by examiner

SPEAKER SYSTEM

TECHNICAL FIELD

The present invention relates to a speaker system. More particularly, the present invention relates to a speaker system which implements satisfactory bass reproduction using a small speaker cabinet.

BACKGROUND ART

In general, a small speaker system has a difficulty in realizing a speaker system capable of satisfactory bass reproduction due to acoustic stiffness of a chamber of a speaker cabinet. Conventionally, in order to realize satisfactory bass reproduction in the small speaker system, there is a speaker system in which an activated carbon body is provided in the cabinet as a means of solving a problem of a bass reproduction limit which is determined based on a cabinet volume (see patent document 1, for example).

FIG. 9 is a cross-sectional view illustrating a main portion of a conventional speaker system. In FIG. 9, the speaker system comprises a cabinet 101, a woofer 102, activated carbon 103, a supporting member 104, a diaphragm 105, and an air tube 106. The woofer 102 is attached to the front of the cabinet 101. The activated carbon 103 in a form of a mass is disposed in the cabinet 101, and supported by a back face, a bottom face, an upper face, left and right side faces of the cabinet 101, as well as the supporting member 104. Note that small air holes for passing air are formed on an entire surface of the supporting member 104. The air tube 106 provided to the diaphragm 105 is operable to ventilate a space between the activated carbon 103 and the woofer 102.

Described next is an operation of the aforementioned speaker system. When an electric signal is applied to the woofer 102, a sound pressure is generated. A pressure in the cabinet 101 is varied by the sound pressure, and the diaphragm 105 is vibrated by the pressure which has been varied. Then, by the vibration of the diaphragm 105, a pressure in a chamber in which the activated carbon 103 is disposed is varied. The activated carbon 103, provided in the form of a mass, is supported by the supporting member 104 and the cabinet 101, and the small air holes are provided on the entire surface of the supporting member 104. Therefore, gas affected by the pressure variation caused by the vibration of the diaphragm 105 is physically adsorbed into the activated carbon 103, thereby suppressing the pressure variation in the cabinet 101.

As described above, in the conventional speaker system, the cabinet 101 operates equivalently to a large volume cabinet. Therefore, the speaker system having a small cabinet is able to realize satisfactory bass reproduction as if the speaker unit is provided in a large cabinet. Also, the air tube 106 is provided so as to prevent a pressure variation, caused by variations in ambient temperature or atmospheric pressure of the speaker system, in a space, including the activated carbon 103, which is enclosed by the diaphragm 105 and the cabinet 101. Note that the pressure variation caused by variations in ambient temperature or atmospheric pressure of the speaker system, occurs at a frequency lower than the bass reproduction limit of the woofer 102, the frequency being close to a direct current component.

[Patent document 1] Japanese Unexamined Patent Publication No. 60-500645

DISCLOSURE OF THE INVENTION

Problems to be Solved by the Invention

However, in the speaker system disclosed in the aforementioned patent document 1, if a pressure variation caused by variations in ambient temperature or atmospheric pressure of the speaker system occurs in a space, including the activated carbon 103, which is enclosed by the diaphragm 105 and the cabinet 101, a pressure affected by the pressure variation is released via the air tube 106 into a space which is an interior of the cabinet 101 in the back of the woofer 102. If the activated carbon 103 is exposed to outside air, the activated carbon 103 absorbs gas or moisture contained in the outside air, and an effect of the activated carbon 103 for physically adsorbing gas deteriorates. Thus, the interior of the cabinet 101 is designed to be more airtight than that of an ordinary sealed cabinet. Therefore, in the conventional speaker system, a chamber in the back of the woofer 102 has high airtightness, whereby the pressure variation in the space including the activated carbon 103 exerts a direct influence on a diaphragm of the woofer 102.

It is assumed that a temperature in the interior of the cabinet 101 increases. When the temperature increases, the activated carbon 103 releases gas or moisture which have been physically adsorbed into the activated carbon 103 rather than suppresses the pressure variation in the interior of the cabinet 101. Therefore, in a closed enclosure type speaker system in which the activated carbon 103 is provided in the interior of the cabinet 101, a pressure in the interior of the cabinet 101 increases, in accordance with the temperature variation, more than in a closed enclosure speaker system in which no activated carbon is provided. When a pressure in a space, including the activated carbon 103, which is enclosed by the diaphragm 105 and the cabinet 101 increases, a high pressure gas released from the air tube 106 pushes the diaphragm of the woofer 102 toward the outside of the cabinet 101. Specifically, a position of the diaphragm of the woofer 102 is deviated from a normal equilibrium position, whereby a driving force generated by a voice coil or a bearing capacity of a suspension becomes nonlinear. As a result, there is a problem that a reproduction sound pressure generated by the speaker system is to be distorted.

On the other hand, in order to solve the aforementioned problem, it may be possible to use a speaker system including a chamber, in the back of the woofer 102, having low airtightness. An example of such a speaker system is a phase inversion type speaker system having an acoustic port or a closed enclosure speaker system whose airtightness is not substantially high. In the above speaker system having low airtightness, the chamber in the back of the woofer 102 also has low airtightness. Thus, the pressure variation caused by the temperature variation is reduced. Accordingly, a deviation of the diaphragm of the woofer 102 from the equilibrium position is also reduced. However, in the speaker system having low airtightness, the outside air enters the interior of the cabinet 101. Thereafter, moisture or gas contained in the outside air are absorbed into the activated carbon 103, thereby deteriorating an effect of the activated carbon 103 for physically adsorbing gas. In other words, there is a problem that an effect of the activated carbon 103 for suppressing a pressure variation in the cabinet 101 caused by the sound pressure is weakened over time.

In the speaker system disclosed in the aforementioned patent document 1, the activated carbon is also provided in the air tube 106 so as to prevent moisture from entering the activated carbon 103. In this case, the activated carbon provided in the air tube 106 deteriorates first, and deterioration of the activated carbon provided in the air tube 106 proceeds over time. Thereafter, moisture or gas contained in the outside air enters the activated carbon 103 enclosed by the cabinet 101. That is, the activated carbon in the air tube 106 is only operable to slow the progression of deterioration of the activated carbon 103 enclosed by the cabinet 101, and is not able to maintain the effect of the activated carbon 103 for suppressing the pressure variation caused by the sound pressure for a long period of time.

Therefore, an object of the present invention is to provide a speaker system capable of maintaining an effect of an adsorption member (e.g., activated carbon) used for suppressing a pressure variation caused by a sound pressure for a long period of time, the speaker system being capable of performing a stable operation even if variations in ambient temperature or atmospheric pressure of the speaker system occur.

Solution to the Problems

A first aspect of the present invention is a speaker system comprising: a cabinet in which a sealed chamber sealed from outside air is formed in at least a portion of an interior chamber of the cabinet; a speaker unit provided in a first opening formed in the cabinet; an adsorption member, disposed in the sealed chamber of the cabinet, for physically adsorbing gas in the sealed chamber; and a variable mechanism, provided in a second opening different from the first opening, formed in the cabinet, for varying a volume of the sealed chamber of the cabinet in accordance with at least a pressure variation of a direct current component, the pressure variation occurring in the sealed chamber, wherein the variable mechanism includes a plate member, and a supporting member, fixed on the second opening, for supporting the plate member such that the plate member is capable of being displaced in a direction in which the volume of the sealed chamber increases or decreases.

In a second aspect of the present invention based on the first aspect, the adsorption member is a porous material.

In a third aspect of the present invention based on the first aspect, the adsorption member is activated carbon.

In a fourth aspect of the present invention based on the first aspect, the interior chamber of the cabinet is formed only by the sealed chamber, the plate member of the variable mechanism is displaced, more easily than a diaphragm of the speaker unit, in accordance with at least the pressure variation of the direct current component, the pressure variation occurring in the sealed chamber, in the direction in which the volume of the sealed chamber increases or decreases, and a resonance frequency of the variable mechanism is lower than that of the speaker unit.

In a fifth aspect of the present invention based on the fourth aspect, the speaker system further comprises a drone cone provided in a third opening, different from the first and the second openings, formed in the cabinet, wherein the plate member of the variable mechanism is displaced, more easily than a diaphragm of the drone cone, in accordance with at least the pressure variation of the direct current component, the pressure variation occurring in the sealed chamber, in the direction in which the volume of the sealed chamber increases or decreases, and the resonance frequency of the variable mechanism is lower than that of the drone cone.

In a sixth aspect of the present invention based on the first aspect, the variable mechanism further includes a first parting board for separating the sealed chamber into a first chamber in which the adsorption member is disposed, and a second chamber contacting the plate member and the supporting member, a sound hole for passing air between the first chamber and the second chamber is formed through the first parting board, and the sound hole functions as a lowpass filter having a cut-off frequency lower than a frequency of a bass reproduction limit of the speaker unit.

In a seventh aspect of the present invention based on the sixth aspect, the interior chamber of the cabinet is formed only by the sealed chamber separated into the first and the second chambers, and the plate member of the variable mechanism is displaced, more easily than a diaphragm of the speaker unit, in accordance with at least the pressure variation of the direct current component, the pressure variation occurring in the sealed chamber, in the direction in which the volume of the sealed chamber increases or decreases.

In an eighth aspect of the present invention based on the seventh aspect, the speaker system further comprises a drone cone, contacting the first chamber, provided in a third opening, different from the first and the second openings, formed in the cabinet, wherein the plate member of the variable mechanism is displaced, more easily than a diaphragm of the drone cone, in accordance with at least the pressure variation of the direct current component, the pressure variation occurring in the sealed chamber, in the direction in which the volume of the sealed chamber increases or decreases.

In a ninth aspect of the present invention based on the sixth aspect, the speaker system further comprises: a second parting board for separating the first chamber from a third chamber, contacting the speaker unit, which is not included in the sealed chamber; a transmission mechanism, provided in an opening formed through the second parting board, for transmitting a pressure variation in the third chamber in a reproduction frequency range of the speaker unit to the first chamber; and a port, provided in the cabinet, for exposing the third chamber to an exterior of the cabinet, wherein the transmission mechanism includes a diaphragm, and a suspension, fixed on the opening formed through the second parting board, for supporting the diaphragm such that the diaphragm is capable of being vibrated in accordance with a reproduction sound pressure of the speaker unit, and the plate member of the variable mechanism is displaced, more easily than the diaphragm of the transmission mechanism, in accordance with at least the pressure variations of the direct current component, the pressure variations occurring in the first and second chambers, in a direction in which the volume of the sealed chamber formed by the first and second chambers increases or decreases.

In a tenth aspect of the present invention based on the ninth aspect, an area of the plate member of the variable mechanism is larger than that of the diaphragm of the transmission mechanism.

In an eleventh aspect of the present invention based on the ninth aspect, a stiffness of the supporting member of the variable mechanism is smaller than that of the suspension of the transmission mechanism.

Effect of the Invention

According to the aforementioned first aspect, the plate member of the variable mechanism is displaced in accordance with at least the pressure variation of the direct current component, the pressure variation occurring in the sealed chamber. As a result, a volume of the sealed space increases or decreases, thereby reducing the pressure variation in the sealed chamber. Thus, the speaker system of the present invention is capable of having stable acoustic performance without being influenced by the pressure variation. Furthermore, the adsorption member is disposed in the sealed chamber which is sealed from the outside air, whereby it becomes possible to realize a speaker system in which deterioration of the adsorption member is suppressed for a long period of time. Specifically, according to the present invention, the stable acoustic performance can be ensured even if an environmental condition of the speaker system changes, and an extension of a bass reproduction range realized by the adsorption member can be maintained for a long period of time.

According to the aforementioned second and third aspects, since the adsorption member is made of activated carbon or other porous materials, a volume of the cabinet equivalently increases, whereby even a small cabinet allows the bass reproduction range to be extended.

According to the aforementioned fourth aspect, the plate member of the variable mechanism is displaced, more easily than the diaphragm of the speaker unit, in accordance with at least the pressure variation of the direct current component, the pressure variation occurring in the sealed chamber. Thus, it becomes possible not to exert on the speaker unit a direct influence caused by the pressure variation. Furthermore, the resonance frequency of the variable mechanism is lower than that of the speaker unit, thereby suppressing a vibration generated by the variable mechanism in accordance with the pressure variation in the reproduction frequency range of the speaker unit. Specifically, the variable mechanism is displaced in accordance with at least the pressure variation of the direct current component, in the direction in which the volume of the sealed space increases or decreases. Thus, it becomes possible to allow the variable mechanism not to emit an undesirable sound in accordance with the pressure variation in the reproduction frequency range of the speaker unit.

According to the aforementioned fifth aspect, the variable mechanism is displaced, in accordance with at least the pressure variation of the direct current component, in the direction in which the volume of the sealed space increases or decreases. Thus, it becomes possible to allow the variable mechanism not to emit the undesirable sound in accordance with the pressure variation in the reproduction frequency ranges of the speaker unit and the drone cone. Furthermore, it becomes possible to realize a phase inversion type speaker system in which the bass reproduction range is further extended by an acoustic resonance of the drone cone. Still furthermore, the phase inversion type speaker system can further increase the bass sound pressure level.

According to the aforementioned sixth aspect, the parting board, through which the sound hole is formed, passes to the second chamber only a pressure variation at a frequency lower than that of a bass reproduction limit of the speaker unit. Thus, even if a pressure in the first chamber is varied by a reproduction sound pressure generated by the speaker unit, it becomes possible to prevent a pressure variation in the second chamber from occurring. As a result, when the speaker unit reproduces music, for example, it becomes possible to allow the variable mechanism not to emit the undesirable sound.

According to the aforementioned seventh aspect, the plate member of the variable mechanism is displaced, more easily than the diaphragm of the speaker unit, in accordance with at least the pressure variation of the direct current component, the pressure variation occurring in the sealed chamber. Thus, it becomes possible not to exert on the speaker unit a direct influence caused by the pressure variation.

According to the aforementioned eighth aspect, the plate member of the variable mechanism is displaced, more easily than the diaphragm of the drone cone, in accordance with at least the pressure variation of the direct current component, the pressure variation occurring in the sealed chamber. Thus, it becomes possible not to exert on the drone cone a direct influence caused by the pressure variation. Furthermore, it becomes possible to realize a phase inversion type speaker system in which the bass reproduction range is further extended by the acoustic resonance of the drone cone. Still furthermore, the phase inversion type speaker system can further increase the bass sound pressure level.

According to the aforementioned ninth aspect, the third chamber is separated from the sealed space, and the port which exposes the third chamber to the exterior of the cabinet is provided therein. Thus, it becomes possible to realize a phase inversion type speaker system in which the bass reproduction range is further extended by the acoustic resonance of the port. Still furthermore, the phase inversion type speaker system can further increase the bass sound pressure level.

According to the aforementioned tenth and eleventh aspects, the plate member of the variable mechanism is displaced in accordance with at least the pressure variations of the direct current component, the pressure variations occurring in the first and second chambers, so as to reduce the pressure variations. Thus, it becomes possible to suppress an influence caused by the pressure variations on the transmission mechanism.

BRIEF DESCRIPTION OF THE DRAWINGS

FIG. 1 is a cross-sectional view illustrating a structure of speaker system according to a first embodiment.

FIG. 2 is a cross-section view illustrating another exemplary structure of the speaker system including an acoustic pipe 19 in a sound hole 15*h* according to the first embodiment.

FIG. 3 is a cross-sectional view illustrating a structure of a speaker system according to a second embodiment.

FIG. 4 is a cross-sectional view illustrating another exemplary structure of the speaker system including a longer sound hole 25*h* so as to be employed as an acoustic pipe according to the second embodiment.

FIG. 5 is a cross-sectional view illustrating a structure of a speaker system according to a third embodiment.

FIG. 6 is a cross-sectional view illustrating another exemplary structure of the speaker system including a drone cone 32 according to the third embodiment.

FIG. 7 is a view illustrating an exemplary structure in which the speaker system according to the present invention is mounted in a slim television.

FIG. 8 is a view illustrating an exemplary structure in which the speaker system according to the present invention is mounted in a vehicle.

FIG. 9 is a cross-sectional view illustrating a structure of a main portion of a conventional speaker system.

DESCRIPTION OF THE REFERENCE CHARACTERS

Figure 1:
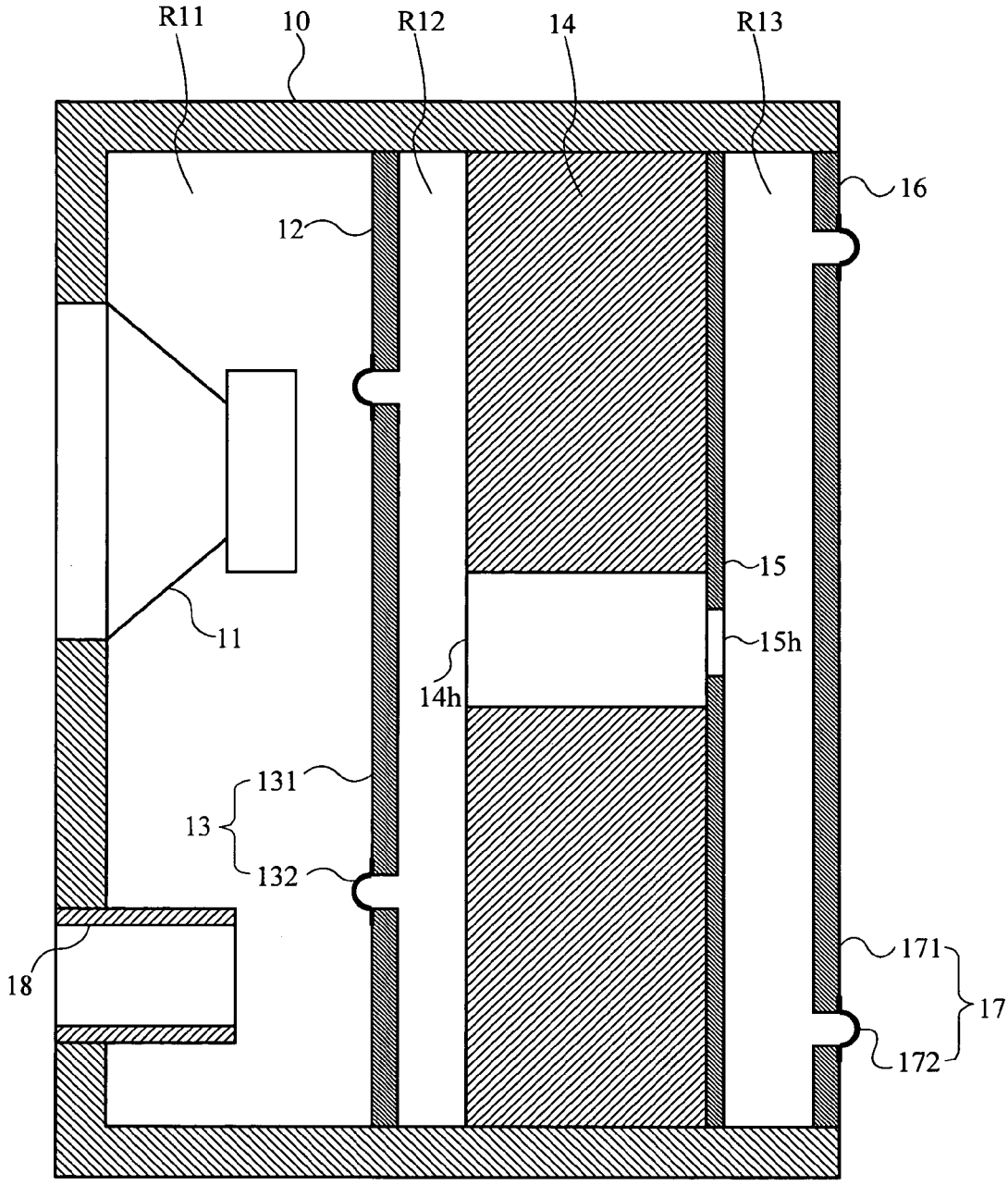
[FIG. 1]

10, 20, 30, 50 cabinet
11, 21, 31, 51 speaker unit
12, 15, 25 parting board
13 transmission mechanism
131, 171, 271, 371, 471 diaphragm
132, 172, 272, 372, 472 suspension
14, 24, 34, 54 adsorption member
16, 26, 36, 56 backboard
17, 27, 37, 57 variable mechanism
18 port

60 slim television body

61 display

70 speaker system

71 vehicle seat

BEST MODE FOR CARRYING OUT THE INVENTION

First Embodiment

A speaker system according to a first embodiment of the present invention is described with reference to FIG. 1. FIG. 1 is a cross-sectional view illustrating a structure of a speaker system according to the first embodiment.

In FIG. 1, the speaker system includes a cabinet 10, a speaker unit 11, a first parting board 12, a drone cone 13, an adsorption member 14, a second parting board 15, a backboard 16, a variable mechanism 17, and a port 18. As shown in FIG. 1, the speaker system according to the first embodiment is a phase inversion type speaker.

The cabinet 10 is defined by a front face, upper face, bottom face, and left and right side faces of a housing of the speaker system. The speaker unit 11 is a dynamic speaker, for example. The speaker unit 11 is attached to an opening formed in the front of the cabinet 10 such that a sound emission surface of the speaker unit 11 faces an exterior of the cabinet 10. The backboard 16 including the variable mechanism 17 is attached to the back of the cabinet 10. The variable mechanism 17 includes a diaphragm 171 having a plate shape and a suspension 172. The suspension 172 is fixed on an opening formed through the backboard 16, and supports the diaphragm 171 in such manner that the diaphragm 171 can be displaced in a direction in which an interior volume of the cabinet 10 increases or decreases. Furthermore, in the interior of the cabinet 10, the first parting board 12 having the drone cone 13 provided therewith is fixed in the back of the speaker unit 11. The drone cone 13 includes a diaphragm 131 and a suspension 132. The suspension 132 is fixed on an opening formed through the first parting board 12, and supports the diaphragm 131 in such manner that the diaphragm 131 can be displaced in accordance with a sound pressure generated by the speaker unit 11. In the present invention, a plate member of a variable mechanism corresponds to the diaphragm 171, and a supporting member corresponds to the suspension 172. In addition, a transmission mechanism in the present invention corresponds to the drone cone 13.

Furthermore, in the interior of the cabinet 10, the second parting board 15 through which a sound hole 15*h* is formed substantially in the middle thereof is fixed in the back of the first parting board 12. An interior space of the speaker system is separated into a first chamber R11, a second chamber R12, and a third chamber R13 by the first parting board 12 having the drone cone 13 and the second parting board 15.

Note that the first chamber R11, the second chamber R12, and the third chamber R13 are formed in an order from the front of the speaker system having the speaker unit 11 provided therein. The first parting board 12 having the drone cone 13 is disposed between the first chamber R11 and the second chamber R12, and the second parting board 15 is disposed between the second chamber R12 and the third chamber R13. The second chamber R12 and the third chamber R13 are sealed chambers which are sealed from the outside air. Furthermore, the port 18 is provided in the front of the cabinet 10, and the first chamber R11 is exposed to the exterior of the cabinet 10 via the port 18.

Areas of the diaphragms 171 and 131 and stiffness of the suspensions 172 and 132 are set, respectively, so as to satisfy conditions described below, for example.

In accordance with variations in ambient temperature or atmospheric pressure of the speaker system, a pressure variation in the interior of the cabinet occurs at a frequency close to a direct current component. Strictly speaking, the pressure variation in the interior of the cabinet occurs due to components including a frequency component generated by variations in temperature or variations in atmospheric pressure. However, the frequency of the frequency component is extremely close to zero as compared to a frequency range which can be reproduced by the speaker unit 11. Therefore, it is no exaggeration to say that the pressure variation in the interior of the cabinet caused by variations in ambient temperature or atmospheric pressure is a pressure variation of the direct current component only (a static pressure variation). In the following description, a pressure variation, in the interior of the speaker system, caused by variations in ambient temperature or atmospheric pressure is referred to as a "pressure variation of a direct current component".

The diaphragm 171 of the variable mechanism 17 is set so as to be displaced, more easily than the diaphragm 131 of the drone cone 13, in accordance with the pressure variation of the direct current component, which is caused by variations in ambient temperature or atmospheric pressure of the speaker system, in a direction in which an interior volume of the cabinet 10 increases or decreases. A displacement X17 of the diaphragm 171 included in the variable mechanism 17 is represented by the following equation (1). In the following equation (1), an area of the diaphragm 171 is denoted by A17, a stiffness of the suspension 172 is denoted by S17, and a pressure of the second chamber R12 is denoted by Pa.

$$X17=Pa*A17/S17 \quad (1)$$

Similarly, a displacement X13 of the drone cone 13 is represented by the following equation (2). In the following equation, an area of the diaphragm 131 is denoted by A13, and a stiffness of the suspension 132 is denoted by S13.

$$X13=Pa*A13/S13 \quad (2)$$

The areas A17 and A13 and the stiffness S17 and S13 are set, respectively, such that the displacements X17 and X13 calculated by the above equations (1) and (2) satisfy the following equation (3).

$$X17>X13 \quad (3)$$

By satisfying the above equation (3), the diaphragm 171 of the variable mechanism 17 is displaced, more easily than the diaphragm 131 of the drone cone 13, in accordance with the pressure variation of the direct current component, in the direction in which the interior volume of the cabinet 10 increases or decreases.

Note that the above equations (1) to (3) are based on a relationship in which a force, generated by the interior pressure of the speaker system, which displaces the diaphragm 171 (or the diaphragm 131) in the direction in which the interior volume of the cabinet 10 increases or decreases, is in proportion to the area of the diaphragm 171 (or the diaphragm 131). Therefore, in order to increase the displacement X17 of the diaphragm 171, the above equation (1) indicates that the area A17 of the diaphragm 171 should be increased so as to increase the force applied to the diaphragm 171. Furthermore, if the area A17 of the diaphragm 171 increases, the diaphragm 171 is more easily displaced in the direction in which the interior volume of the cabinet 10 increases or decreases, due to factors other than the force generated based on the relationship between the area A17 of the diaphragm 171 and the interior pressure. For example, if the area A17 of the diaphragm 171 increases, there is a factor in which a magnitude of a mechanical impedance is inversely proportional to the square of the area A17 of the diaphragm 171, thereby reducing an equivalent mass of the diaphragm 171. By this factor, when the area A17 of the diaphragm 171 is set so as to be larger than the area A13 of the diaphragm 131, the equivalent mass of the diaphragm 171 becomes smaller than that of the diaphragm 131. As a result, the diaphragm 171 of the variable mechanism 17 is displaced, more easily than the diaphragm 131 of the drone cone 13, in accordance with the pressure variation of the direct current component, in the direction in which the interior volume of the cabinet 10 increases or decreases.

Note that the diaphragm 171 of the variable mechanism 17 should be set so as to be displaced, more easily than the diaphragm 131 of the drone cone 13, in accordance with at least the pressure variation of the direct current component. In other words, in accordance with other pressure variations (dynamic pressure variations) occurred in a frequency range higher than a frequency of the direct current component, the diaphragm 171 of the variable mechanism 17 may be displaced (vibrated) more or less easily than the diaphragm 131 of the drone cone 13.

The adsorption member 14 is disposed in the second chamber R12. The adsorption member 14 is a porous material which physically adsorbs gas. For example, the adsorption member 14 is activated carbon. The porous material can physically adsorb gas into pores each having a size in the order of micrometers. As other examples of the porous materials, carbon nanotube, fullerene, zeolite, silica ($SiO_2$), alumina ($Al_2O_3$), zirconia ($ZrO_3$), magnesia (MgO), nitrogen tetroxide ($Fe_3O_4$), molecular sieve and the like can be used. An opening 14*h* penetrating in a fore-and-aft direction of the speaker system is formed substantially in the middle of the adsorption member 14, for example.

The second chamber R12, the second parting board 15 and the sound hole 15*h* function as a lowpass filter for passing, from the second chamber R12 through the third chamber R13, only a pressure variation at a frequency lower than that of a bass reproduction limit of the speaker unit 11. In other words, the second chamber R12, the second parting board 15 and the sound hole 15*h* function as the lowpass filter for preventing a pressure variation in a reproduction frequency range of the speaker unit 11 from passing through the variable mechanism 17. For example, if the bass reproduction limit of the speaker unit 11 is 50 Hz, a cut-off frequency of the lowpass filter is set at a frequency lower than an audible frequency range (e.g., 20 Hz). Note that by satisfying the above equation (3), the diaphragm 171 of the variable mechanism 17 is displaced, more easily than the diaphragm 131 of the drone cone 13, in accordance with at least the pressure variation of the direct current component. However, in other frequency ranges, the diaphragm 171 of the variable mechanism 17 may be vibrated by a sound pressure generated from the speaker unit 11. Thus, the aforementioned lowpass filter can suppress a vibration, generated by the sound pressure, of the diaphragm 17 of the variable mechanism 17.

Described next is an operation of the speaker system according to the first embodiment. In FIG. 1, the speaker unit 11 is a dynamic speaker which operates in a well-known manner, and a detailed description thereof is omitted here. When an audio signal is applied to the speaker unit 11, a force is generated by a voice coil to vibrate a cone diaphragm, thereby generating a sound pressure. The sound pressure generated by the cone diaphragm is transmitted to the diaphragm 131 of the drone cone 13 via the first chamber R11 formed in the cabinet 10. Since the diaphragm 131 is supported by the suspension 132 so as to be displaced in accordance with the sound pressure, the diaphragm 131 is vibrated so as to vary an interior pressure in the second chamber R12. However, the adsorption member 14 is disposed in the second chamber R12. Thus, a pressure variation in the second chamber R12 is suppressed by the adsorption member 14 providing an effect of physical adsorption, and a volume of the second chamber R12 is equivalently increased. Specifically, the speaker system operates as if the speaker unit is provided in a large volume cabinet, and operates as if the speaker system is a phase inversion type speaker having a large volume by an effect of the port 18.

As described above, the cut-off frequency of the lowpass filter formed by the second chamber R12, the second parting board 15 and the sound hole 15*h* is a frequency lower than that of a sound pressure generated by the speaker unit 11. Therefore, the sound pressure will not pass through the sound hole 15*h*. That is, the aforementioned lowpass filter is operable to prevent the sound pressure from being transmitted to the variable mechanism 17, thus making it possible to suppress emission of an undesirable sound produced by the vibration of the variable mechanism 17.

On the other hand, the interior pressure of the second chamber R12 varies in accordance with variations in ambient temperature or atmospheric pressure of the speaker system, heat generation of the speaker unit 11, and the like. For example, when the interior temperature of the second chamber R12 increases, air in the second chamber R12 is expanded, thus increasing a pressure in the second chamber R12. Thereafter, the adsorption member 14 operates so as to suppress the pressure increase. However, in a case where a pressure increase occurs together with a temperature increase, the adsorption member 14 is operable to provide an effect of releasing air or moisture adsorbed thereinto, rather than of suppressing the pressure increase. Thus, generally specking, the pressure in the second chamber R12 having the adsorption member 14 is increased, as compared to the second chamber R12 having no adsorption member 14. As described above, the pressure variation caused by the aforementioned pressure increase occurs at the frequency extremely lower than that of the bass reproduction limit of the speaker unit 11, and occurs at a frequency close to a direct current component.

The second chamber R12, the second parting board 15 and the sound hole 15*h* function as the lowpass filter for passing, from the second chamber R12 through the third chamber R13, only the pressure variation at the frequency lower than that of the bass reproduction limit of the speaker unit 11. Thus, since a pressure increased in the second chamber R12 is the pressure to be varied at the frequency close to the direct current component, the pressure is transmitted to the third chamber R13 via the sound hole 15*h*. Furthermore, the diaphragm 171 of the variable mechanism 17 is set so as to be displaced, more easily than the diaphragm 131 of the drone cone 13, in accordance with at least the pressure variation of the direct current component. Therefore, by the pressure transmitted to the third chamber R13, only the diaphragm 171 of the variable mechanism 17 is displaced in a direction toward the back of the cabinet 10. If an interior pressure in the chamber R13 becomes higher than a predetermined pressure, the diaphragm 131 of the drone cone 13 is also displaced. However, a displacement of the diaphragm 131 of the drone cone 13 is considerably smaller than that of the diaphragm 171 of the variable mechanism 17. By the displacement of the diaphragm 171 of the variable mechanism 17, a volume of the third chamber R13 is increased. As a result, the pressure increases in the second chamber R12 and the third chamber R13 are reduced. Furthermore, since the pressure increases are reduced, an influence exerted on the drone cone 13 by the pressure increases is to be suppressed.

As described above, when the pressure variation in the second chamber R12 occurs in accordance with variations in ambient temperature or atmospheric pressure of the speaker system, the diaphragm 171 of the variable mechanism 17 is displaced in accordance with the pressure variation of the direct current component in a direction in which the volume of the third chamber R13 increases or decreases. Then, the interior pressures in the second and third chambers R12 and R13 are reduced by the above displacement, thereby suppressing a direct influence exerted on the drone cone 13. Thus, the speaker system can maintain a performance similar to that in an initial state (before a pressure variation occurs in accordance with variations in ambient temperature or atmospheric pressure).

The adsorption member 14 is disposed in the second chamber R12, and the second chamber R12 is sealed from the outside air. Thus, the adsorption member 14 is prevented from deteriorating due to an effect of the outside air, thereby allowing the adsorption member 14 to maintain an effect of extending a bass reproduction range for a long period of time without being deteriorated.

The present embodiment illustrates an example where the cut-off frequency of the lowpass filter should be set at the frequency lower than that of the bass reproduction limit of the speaker unit 11. However, the cut-off frequency of the lowpass filter is preferably set at a lower frequency. In the aforementioned example, even if the frequency of the bass reproduction limit of the speaker unit 11 is 50 Hz, the cut-off frequency is set at the frequency lower than the audible frequency range (e.g., 20 Hz), thereby further suppressing an influence exerted on the variable mechanism 17 by the sound pressure generated by the speaker unit 11. In the case of setting the cut-off frequency of the lowpass filter, the cut-off frequency is set at a predetermined frequency under an assumption that the adsorption member 14 is not disposed in the speaker system, for example. In practice, the volume of the second chamber R12 is spuriously increased by the adsorption member 14. Therefore, an actual cut-off frequency becomes lower than the predetermined frequency having been set. In other words, with the adsorption member 14, the cut-off frequency does not become higher than the predetermined frequency having been set. Thus, no unexpected and undesirable sound is to be emitted from the variable mechanism 17. Alternatively, a spurious volume increase generated by the adsorption member 14 may be previously estimated to set the cut-off frequency.

Figure 2:
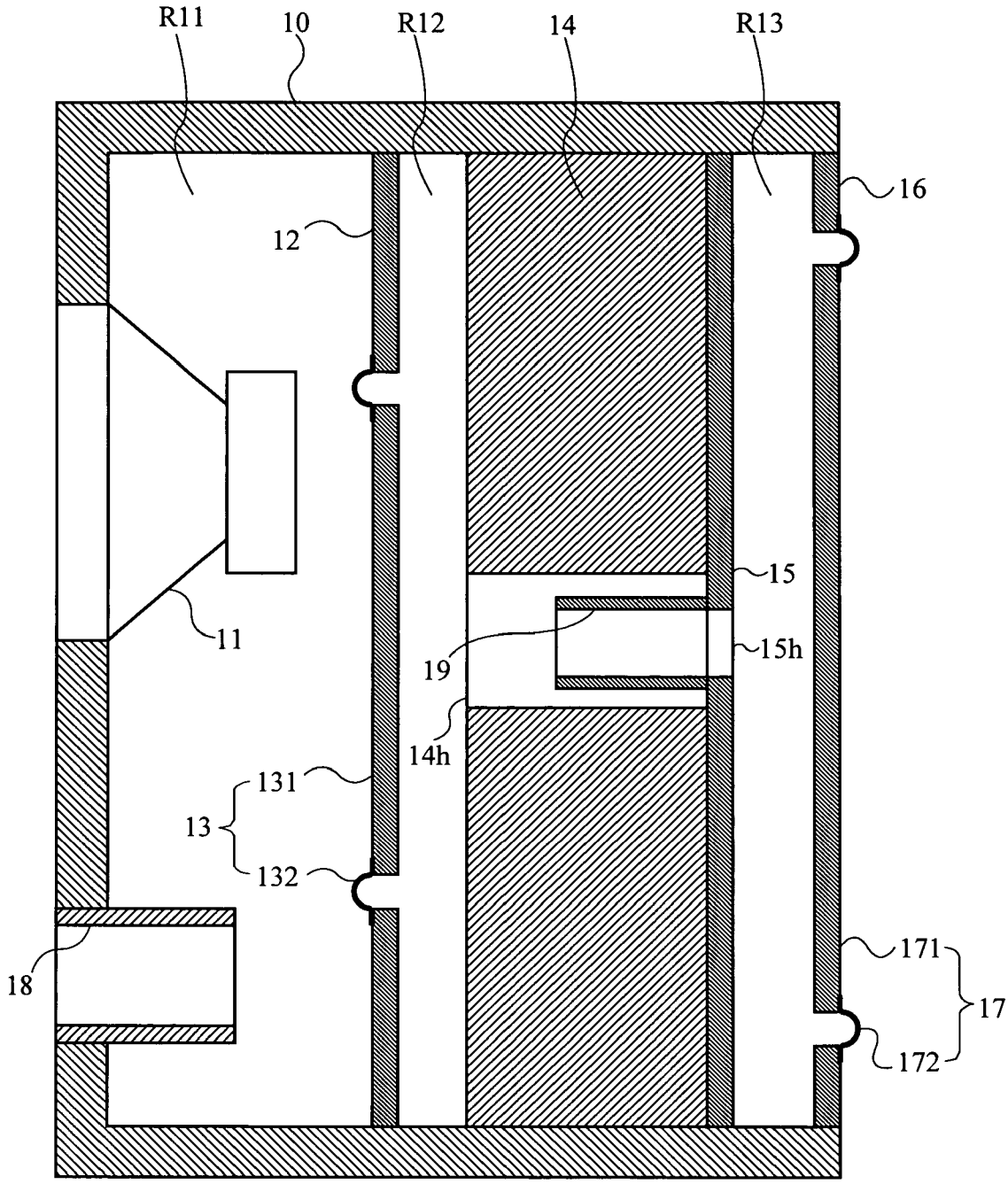
[FIG. 2]

The present embodiment illustrates an example where the speaker system includes the sound hole 15*h* formed through the second parting board 15, so as to function as the lowpass filter. However, as shown in FIG. 2, the speaker system may include an acoustic pipe 19 connected to the sound hole 15*h* so as to have a longer hole. FIG. 2 is a cross-sectional view illustrating another exemplary structure of the speaker system including the acoustic hole 19 in the sound hole 15*h*. In this speaker system, an acoustic load can be further applied to the acoustic pipe 19, thereby allowing the cut-off frequency of the lowpass filter to be set at a lower frequency. As a result, when the speaker unit 11 is in operation, the sound pressure is less easily transmitted to the variable mechanism 17, thereby further suppressing emission of the undesirable sound produced by the variable mechanism 17.

Furthermore, the present embodiment illustrates an example where each of the variable mechanism 17 and the drone cone 13 includes a diaphragm and a suspension in an individual manner. However, the diaphragm and the suspension made of similar or different materials may be integrally formed.

Still furthermore, the present embodiment illustrates an example where the speaker system is a phase inversion type speaker having the port 18 provided therein. However, instead of the port 18, the speaker system may be a phase inversion type speaker having a drone cone provided therein. Or the speaker system may be sealed with no port 18 provided therein. In such cases, the first chamber R11, disposed immediately behind the speaker unit 11, is hermetically sealed. As described above, however, even if the pressure variation in the second chamber R12 occurs in accordance with variations in ambient temperature or atmospheric pressure of the speaker system, an influence exerted on the drone cone 13 is suppressed. Thus, there is no direct influence on the speaker unit 11 and the aforementioned drone cone, thereby making it possible to ensure a stable operation.

Still furthermore, the present invention illustrates an example where the backboard 16 and cabinet 10 are separately formed. However, the cabinet 10 may integrally form a back face thereof. In this case, the variable mechanism 17 is attached to an opening formed on the back face of the cabinet 10.

Second Embodiment

Figure 3:
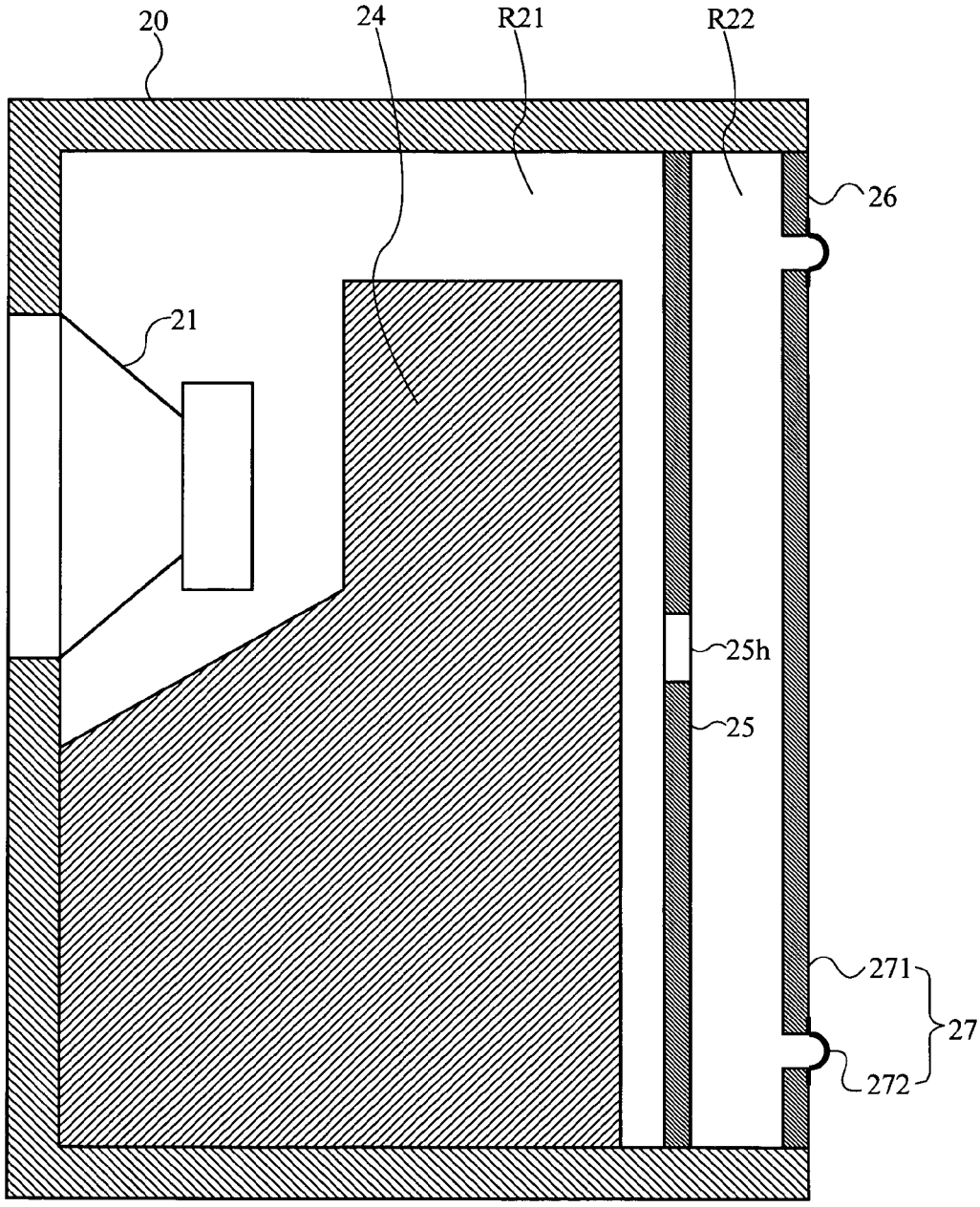
[FIG. 3]

A speaker system according to a second embodiment of the present invention is described with reference to FIG. 3. FIG. 3 is a cross-sectional view illustrating a structure of a speaker system according to the second embodiment.

In FIG. 3, the speaker system includes a cabinet 20, a speaker unit 21, an adsorption member 24, a backboard 26, and a variable mechanism 27. As shown in FIG. 3, the speaker system according to the second embodiment is a closed enclosure type speaker. The speaker unit 21, the first parting board 25, and the backboard 26 in the second embodiment have the same functions as the speaker unit 11, the second parting board 15, and the backboard 16 in the first embodiment, respectively. Thus, detailed descriptions thereof are omitted here. The adsorption member 24 is similar to the adsorption member 14 in the first embodiment except that these adsorption members have different shapes.

The cabinet 20 is defined by a front face, upper face, bottom face, and left and right side faces of a housing of the speaker system. The speaker unit 21 is attached to an opening formed in the front of the cabinet 20 such that a sound emission surface of the speaker unit 21 faces an exterior of the cabinet 20. The backboard 26 including the variable mechanism 27 is attached to the back of the cabinet 20. The variable mechanism 27 includes a diaphragm 271 having a plate shape and a suspension 272. The suspension 272 is fixed on an opening formed through the backboard 26, and supports the diaphragm 271 in such manner that the diaphragm 271 can be displaced in a direction in which an interior volume of the cabinet 20 increases or decreases. In the present invention, a plate member of a variable mechanism corresponds to the diaphragm 271, and a supporting member corresponds to the suspension 272.

Furthermore, in the interior of the cabinet 20, the first parting board 25 through which a sound hole 25*h* is formed is fixed in the back of the speaker unit 21. An interior space of the speaker system is separated into a first chamber R21 and a second chamber R22 by the first parting board 25.

The first chamber R21 and the second chamber R22 are formed in an order from the front of the speaker system having the speaker unit 21 provided therein. The first parting board 25 is disposed between the first chamber R21 and the second chamber R22. The first chamber R21 and the second chamber R22 are sealed chambers which are sealed from the outside air. Since the speaker system in the present embodiment is a closed enclosure type speaker, the first chamber R21 and the second chamber R22 are hermetically sealed.

In the variable mechanism 27, an area of the diaphragm 271 and a stiffness of the suspensions 272 are set, respectively, so as to satisfy conditions described below, for example. The diaphragm 271 of the variable mechanism 27 is set so as to be displaced, more easily than a diaphragm of the speaker unit 21, in accordance with the pressure variation of the direct current component, which is caused by variations in ambient temperature or atmospheric pressure of the speaker system, in a direction in which volumes of the first chamber R21 and the second chamber R22 increase or decrease. A displacement X27 of the diaphragm 271 is represented by the following equation (4). In the following equation (4), an area of the diaphragm 271 is denoted by A27, a stiffness of the suspension 272 is denoted by S27, and a pressure of the first chamber R21 is denoted by Pb.

$$X27=Pb*A27/S27 \quad (4)$$

Similarly, a displacement X21 of the diaphragm of the speaker unit 21 is represented by the following equation (5). In the following equation (5), an area of the diaphragm of the speaker unit 21 is denoted by A21, and a stiffness of the suspension is denoted by S21.

$$X21=Pb*A21/S21 \quad (5)$$

The area A27 and the stiffness S27 are set, respectively, such that the displacements X27 and X21 calculated by the above equations (4) and (5) satisfy the following equation (6).

$$X27>X21 \quad (6)$$

By satisfying the above equation (6), the diaphragm 271 of the variable mechanism 27 is displaced, more easily than the diaphragm of the speaker unit 21, in accordance with the pressure variation of the direct current component, in the direction in which the volumes of the first chamber R21 and the second chamber R22 increase or decrease.

Similarly to the first embodiment above, the diaphragm 271 of the variable mechanism 27 should be set so as to be displaced, more easily than the diaphragm of the speaker unit 21, in accordance with at least the pressure variation of the direct current component. In other words, in accordance with other pressure variations occurred in a frequency range higher than that of the direct current component, the diaphragm 271 of the variable mechanism 27 may be displaced more or less easily than the diaphragm of the speaker unit 21.

The adsorption member 24 is disposed in the first chamber R21. The adsorption member 24 is a porous material which is similar to the adsorption member 14 described in the first embodiment.

Similarly to the first embodiment described above, the first chamber R21, the first parting board 25 and the sound hole 25*h* function as a lowpass filter for passing, from the first chamber R21 through the second chamber R22, only a pressure variation at a frequency lower than that of a bass reproduction limit of the speaker unit 21. For example, in the present embodiment, the bass reproduction limit of the speaker unit 21 is set at 50 Hz, and a cut-off frequency of the lowpass filter is set at a frequency lower than an audible frequency range (e.g., 20 Hz).

Described next is an operation of the speaker system according to the second embodiment. In FIG. 3, when an audio signal is applied to the speaker unit 21, a force is generated by a voice coil to vibrate a cone diaphragm, thereby generating a sound pressure. By the sound pressure generated by the cone diaphragm, an interior pressure of the first chamber R21 is increased. However, since the adsorption member 24 is disposed in the first chamber R21, a pressure variation in the first chamber R21 is suppressed by the adsorption member 24 providing an effect of physical adsorption, and a volume of the first chamber R21 is equivalently increased. Specifically, the speaker system operates as if the speaker unit is provided in a large volume cabinet.

As described above, the cut-off frequency of the lowpass filter formed by the first chamber R21, the first parting board 25 and the sound hole 25*h* is a frequency lower than that of a sound pressure generated by the speaker unit 21. Therefore, the sound pressure will not pass through the sound hole 25*h*. That is, the aforementioned lowpass filter is operable to prevent the sound pressure from being transmitted to the variable mechanism 27, thus making it possible to suppress emission of an undesirable sound produced by vibration of the variable mechanism 27.

On the other hand, the interior pressure of the first chamber R21 varies in accordance with variations in ambient temperature or atmospheric pressure of the speaker system, heat generation of the speaker unit 21, and the like. Reasons for the pressure variation caused by the adsorption member 24 which releases gas, are the same in the first embodiment above. The first chamber R21, the first parting board 25 and the sound hole 25*h* function as the lowpass filter for passing, from the speaker unit 21 through the second chamber R22, only the pressure variation at the frequency lower than that of the bass reproduction limit of the speaker unit 21. Thus, since a pressure increased in the first chamber R21 is the pressure to be varied at a frequency close to the direct current component, the pressure is transmitted to the second chamber R22 via the sound hole 25*h*. Furthermore, the diaphragm 271 of the variable mechanism 27 is set so as to be displaced, more easily than the diaphragm of the speaker unit 21, in accordance with at least the pressure variation of the direct current component. Therefore, by the pressure transmitted to the second chamber R22, only the diaphragm 271 of the variable mechanism 27 is displaced in a direction toward the back of the cabinet 20. If each of the interior pressures in the first chamber and the second chamber becomes higher than a predetermined pressure, the diaphragm of the speaker unit 21 is also displaced. However, a displacement of the diaphragm of the speaker unit 21 is considerably smaller than that of the diaphragm 271 of the variable mechanism 27. By the displacement of the diaphragm 271 of the variable mechanism 27, the volumes of the first chamber R21 and the second chamber R22 are increased. As a result, the pressure increases in the first chamber R21 and the second chamber R22 are reduced. Furthermore, since the pressure increases are reduced, a direct influence exerted on the speaker unit 21 by the pressure increases is to be suppressed. That is, a position of the diaphragm of the speaker unit 21 is not to be deviated from a normal equilibrium position, thereby making it possible to ensure a stable operation.

As described above, when the pressure variations in the first chamber R21 and the second chamber R22 occur in accordance with variations in ambient temperature or atmospheric pressure of the speaker system, the diaphragm 271 of the variable mechanism 27 is displaced, in accordance with the pressure variation of the direct current component, in the direction in which the volumes of the first chamber R21 and the second chamber R22 increase or decrease. Then, the volumes of the first and second chambers R21 and R22 are increased or decreased by the above displacement, and pressures in the first and second chambers R21 and R22 are reduced, thereby suppressing a direct influence exerted on the speaker unit 21.

Since the speaker system in the present embodiment is a closed enclosure type speaker, the adsorption member 24 is disposed so as to be sealed from the outside air. Therefore, even under the environment where variations in ambient temperature or atmospheric pressure occur, the adsorption member 24 is prevented from deteriorating due to an effect of the outside air, thereby allowing the adsorption member 24 to maintain an effect of extending a bass reproduction range for a long period of time.

Similarly to the first embodiment above, the present embodiment illustrates an example where the cut-off frequency of the lowpass filter should be set at a frequency lower than that of the bass reproduction limit of the speaker unit 21. However, the cut-off frequency of the lowpass filter is preferably set at a lowest possible frequency.

Figure 4:
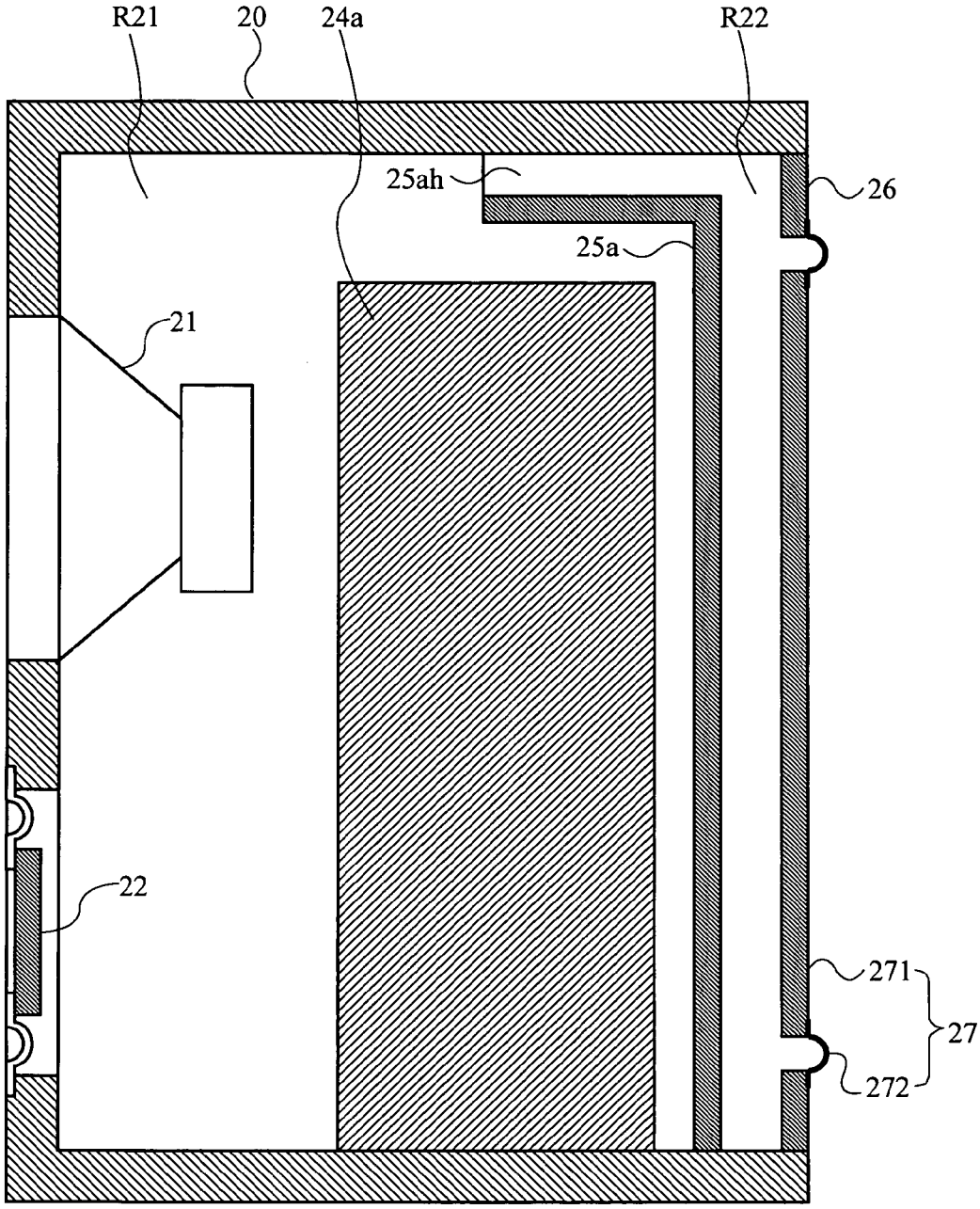
[FIG. 4]

Furthermore, similarly to the first embodiment above, the present embodiment illustrates an example where the speaker system includes the sound hole 25*h* formed through the first parting board 25, so as to function as the lowpass filter. However, as shown in FIG. 4, the speaker system may include a longer sound hole 25*ah* so as to be employed as an acoustic pipe. FIG. 4 is a cross-sectional view illustrating another exemplary structure of the speaker system including the longer sound hole 25*ah* so as to be employed as the acoustic pipe according to the second embodiment. In this speaker system, an acoustic load can be further applied to the longer sound hole 25*ah*, thereby allowing the cut-off frequency of the lowpass filter to be set at a lower frequency. As a result, when the speaker unit 21 is in operation, the sound pressure is less easily transmitted to the variable mechanism 27, thereby further suppressing emission of the undesirable sound produced by the variable mechanism 27.

The speaker system shown in FIG. 4 is a phase inversion type speaker system including a drone cone 22. In FIG. 4, an area of the diaphragm 271 of the variable mechanism 27 and a stiffness of the suspension 272 of the variable mechanism 27 should be set in accordance with the pressure variation of the direct current component, respectively, so as to satisfy the above equation (6) and the following equation (7). Note that a diaphragm displacement of the drone cone 22 caused by a pressure in the first chamber R21 is denoted by X22.

$$X27>X22 \tag{7}$$

By satisfying the above equations (6) and (7), the diaphragm 271 of the variable mechanism 27 is displaced, more easily than the diaphragm of the speaker unit 21 and a diaphragm of the drone cone 22, in accordance with the pressure variation of the direct current component, in a direction in which the interior volume of the cabinet 20 increases or decreases. Thus, even if a pressure variation in the first chamber R21 occurs in accordance with variations in ambient temperature or atmospheric pressure of the speaker system, a direct influence exerted on the speaker unit 21 and the drone cone 22 is suppressed. That is, each of positions of the diaphragms of the speaker unit 21 and the drone corn 22 is not to be deviated from a normal equilibrium position, thereby making it possible to ensure a stable operation.

Third Embodiment

Figure 5:
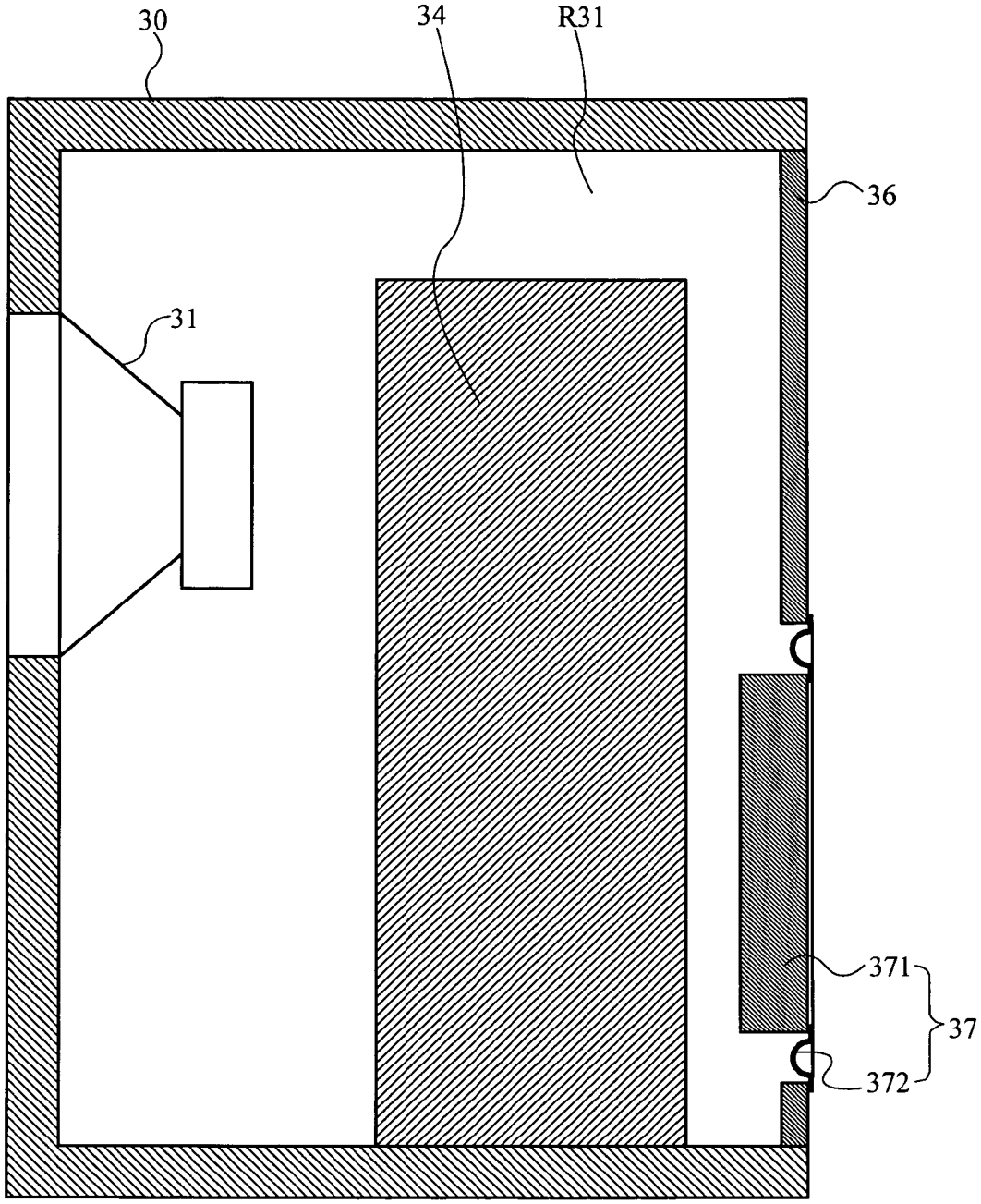
[FIG. 5]

A speaker system according to a third embodiment of the present invention is described with reference to FIG. 5. FIG. 5 is a cross-sectional view illustrating a structure of a speaker system according to the third embodiment.

In FIG. 5, the speaker system includes a cabinet 30, a speaker unit 31, an adsorption member 34, a backboard 36, and a variable mechanism 37. As shown in FIG. 5, the speaker system according to the third embodiment is a closed enclosure type speaker having a chamber R31 enclosed by the cabinet 30 and the backboard 36. The speaker unit 31 and the backboard 36 in the third embodiment have the same functions as the speaker unit 11 and the backboard 16 in the first embodiment, respectively. Thus, detailed descriptions thereof are omitted here. The adsorption member 34 is similar to the adsorption member 14 in the first embodiment except that these adsorption members have different shapes.

The cabinet 30 is defined by a front face, upper face, bottom face, and left and right side faces of a housing of the speaker system. The speaker unit 31 is attached to an opening formed in the front of the cabinet 30 such that a sound emission surface of the speaker unit 31 faces an exterior of the cabinet 30. The backboard 36 including the variable mechanism 37 is attached to the back of the cabinet 30. The variable mechanism 37 includes a diaphragm 371 having a plate shape and a suspension 372. The suspension 372 is fixed on an opening formed through the backboard 36, and supports the diaphragm 371 in such manner that the diaphragm 371 can be displaced in a direction in which an interior volume of the cabinet 30 increases or decreases. In the present invention, a plate member of a variable mechanism corresponds to the diaphragm 371, and a supporting member corresponds to the suspension 372.

In the variable mechanism 37, an area of the diaphragm 371 and a stiffness of the suspensions 372 are set, respectively, so as to satisfy conditions described below, for example. The diaphragm 371 of the variable mechanism 37 is set so as to be displaced, more easily than a diaphragm of the speaker unit 31, in accordance with the pressure variation of the direct current component, which is caused by variations in ambient temperature or atmospheric pressure of the speaker system, in a direction in which a volume of the chamber R31 increases or decreases. A displacement X37 of the diaphragm 371 is represented by the following equation (8). In the following equation (8), an area of the diaphragm 371 is denoted by A37, a stiffness of the suspension 372 is denoted by S37, and a pressure of the chamber R31 is denoted by Pc.

$$X37=Pc*A37/S37 \tag{8}$$

Similarly, a displacement X31 of the diaphragm of the speaker unit 31 is represented by the following equation (9). In the following equation (9), an area of the diaphragm of the speaker unit 31 is denoted by A31, and a stiffness of the suspension is denoted by S31.

$$X31=Pc*A31/S31 \tag{9}$$

The area A37 and the stiffness S37 are set, respectively, such that the displacements X37 and X31 calculated by the above equations (8) and (9) satisfy the following equation (10).

$$X37>X31 \tag{10}$$

By satisfying the above equation (10), the diaphragm 371 of the variable mechanism 37 is displaced, more easily than the diaphragm of the speaker unit 31, in accordance with the pressure variation of the direct current component, in the direction in which the volume of the chamber R31 increases or decreases.

Note that the diaphragm 371 of the variable mechanism 37 should be set so as to be displaced, more easily than the diaphragm of the speaker unit 31, in accordance with at least the aforementioned pressure variation of the direct current component. However, in the present embodiment, the following conditions are further required.

A resonance frequency f37 of the variable mechanism 37 is required to be set so as to be lower than a resonance frequency f31 of the speaker unit 31. Thus, vibration of the variable mechanism 37 is suppressed in a reproduction frequency range of the speaker unit 31. As a result, an undesirable sound is less likely to be produced by the variable mechanism 37 in the reproduction frequency range of the speaker unit 31. The resonance frequency f37 is calculated based on a stiffness of the chamber R31, amass of the diaphragm 371, and a stiffness of the suspension 372. Similarly, the resonance frequency f31 is calculated based on the stiffness of the chamber R31, a mass of the diaphragm of the speaker unit 31, and the stiffness of the suspension. Therefore, the mass of the diaphragm 371 and the stiffness of the suspension 372 are properly set such that the resonance frequency f37 of the variable mechanism 37 is set to be lower than the resonance frequency f31 of the speaker unit 31. Note that the larger the mass of the diaphragm 371 is, the lower the resonance frequency f37 of the variable mechanism 37 becomes, and the smaller the stiffness of the suspension 372 is, the lower the resonance frequency f37 of the variable mechanism 37 becomes. Furthermore, the resonance frequency f37 of the variable mechanism 37 is preferably set at a lowest possible frequency. For example, the resonance frequency f37 of the variable mechanism 37 may be set at a frequency lower than an audible frequency range (20 Hz or less). The adsorption member 34 is a porous material which is similar to the adsorption member 14 described in the first embodiment.

Described next is an operation of the speaker system according to the third embodiment. In FIG. 5, when an audio signal is applied to the speaker unit 31, a force is generated by a voice coil to vibrate a cone diaphragm, thereby generating a sound pressure. By the sound pressure generated by the cone diaphragm, an interior pressure of the chamber R31 is increased. However, the adsorption member 34 is disposed in the first chamber R31. Thus, a pressure variation in the chamber R31 is suppressed by the adsorption member 34 providing an effect of physical adsorption, and a volume of the chamber R31 is equivalently increased. Specifically, the speaker system operates as if the speaker unit is provided in a large volume cabinet.

As described above, the resonance frequency f37 of the variable mechanism 37 is set so as to be lower than the resonance frequency f31 of the speaker unit 31. Therefore, the vibration of the variable mechanism 37 is suppressed in the reproduction frequency range of the speaker unit 31. That is, the emission of the undesirable sound produced by the variable mechanism 37 is suppressed in the reproduction frequency range of the speaker unit 31.

On the other hand, the interior pressure of the chamber R31 varies in accordance with variations in ambient temperature or atmospheric pressure of the speaker system, heat generation of the speaker unit 31, and the like. Reasons for the pressure variation caused by the adsorption member 34 which releases gas, are the same as in the first embodiment above. The diaphragm 371 of the variable mechanism 37 is set so as to be displaced, more easily than the diaphragm of the speaker unit 31, in accordance with at least the pressure variation of the direct current component. Therefore, by the pressure increased in the chamber R31, only the diaphragm 371 of the variable mechanism 37 is displaced in a direction toward the back of the cabinet 30. If the interior pressure in the chamber R31 becomes higher than a predetermined pressure, the diaphragm of the speaker unit 31 is also displaced. However, a displacement of the diaphragm of the speaker unit 31 is considerably smaller than that of the diaphragm 371 of the variable mechanism 37. By the displacement of the diaphragm 371 of the variable mechanism 37, a volume of the chamber R31 is increased. As a result, the pressure increase in the chamber R31 is reduced. Furthermore, since the pressure increase in the chamber R31 is reduced, a direct influence exerted on the speaker unit 31 by the pressure increase is to be suppressed. That is, a position of the diaphragm of the speaker unit 31 is not to be deviated from a normal equilibrium position, thereby making it possible to ensure a stable operation.

As described above, when the pressure variation in the chamber R31 occurs in accordance with variations in ambient temperature or atmospheric pressure of the speaker system, the diaphragm 371 of the variable mechanism 37 is displaced, in accordance with the pressure variation of the direct current component, in the direction in which the volume of the chamber R31 increases or decreases. Then, the volume of the chamber R31 is increased or decreased by the above displacement, thereby suppressing a direct influence exerted on the speaker unit 31.

Since the speaker system in the present embodiment is a closed enclosure type speaker, the chamber R31 having the adsorption member 34 is sealed from the outside air. Therefore, even under the environment where variations in ambient temperature or atmospheric pressure occur, the adsorption member 34 such as activated carbon is prevented from deteriorating due to an effect of the outside air, thereby allowing the adsorption member 34 to maintain an effect of extending a bass reproduction range for a long period of time. Furthermore, a lowpass filter, which is provided in the first and second embodiments, is not necessary in the present embodiment, thereby simplifying a structure of the speaker system.

Figure 6:
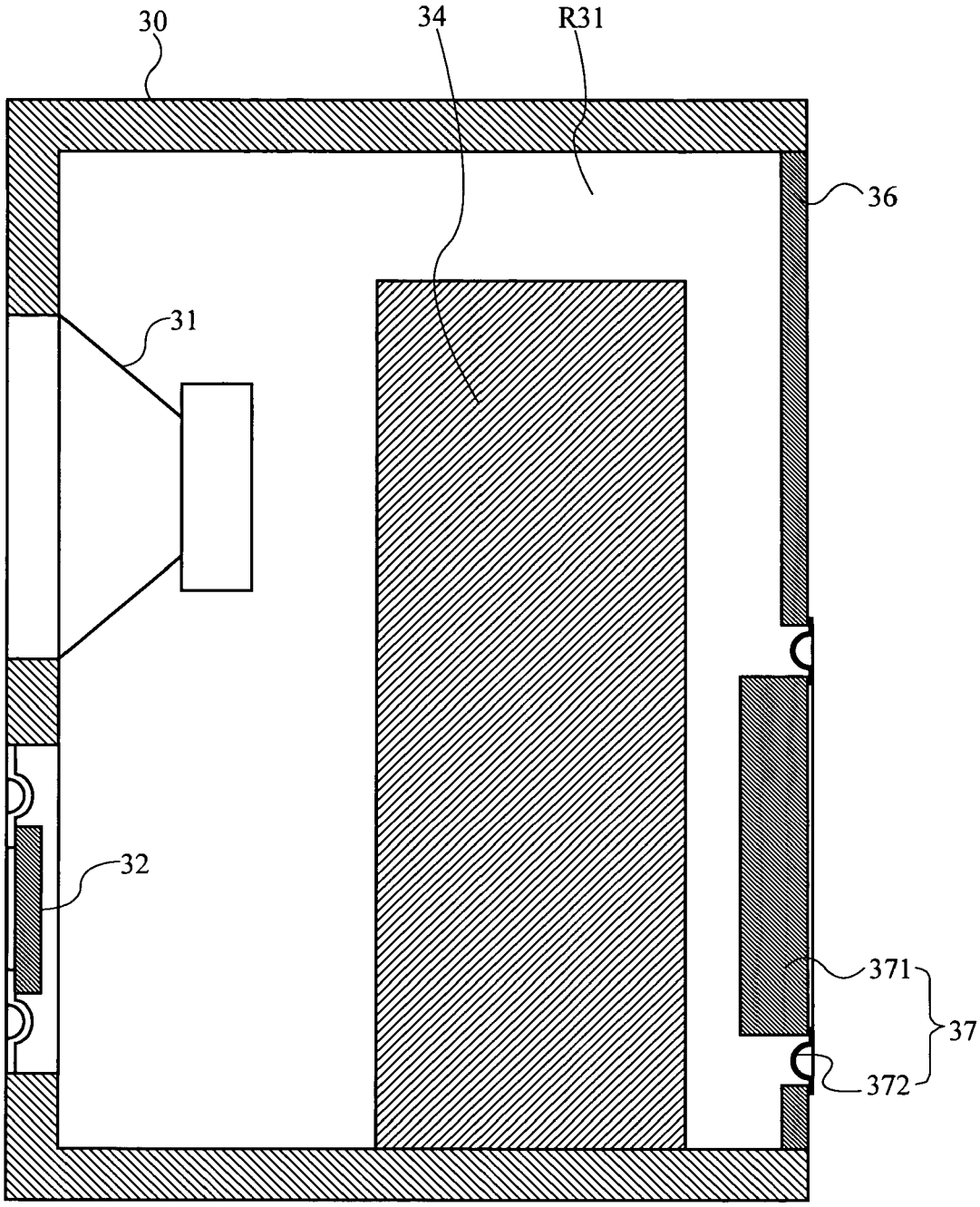
[FIG. 6]

As shown in FIG. 5, the present embodiment described above illustrates an example where the speaker system is a closed enclosure type speaker system. However, as shown in FIG. 6, the speaker system may be a phase inversion type speaker system including a drone cone 32. FIG. 6 is a cross-sectional view illustrating another exemplary structure of the speaker system including the drone cone 32 according to the third embodiment. In the variable mechanism 37, an area of the diaphragm 371 and a stiffness of the suspension 372 should be set, respectively, so as to satisfy the above equation (10) and the following equation (11). Note that a diaphragm displacement of the drone cone 32 caused by a pressure in the chamber R31 is denoted by X32.

$$X37>X32 \tag{11}$$

By satisfying the above equations (10) and (11), the diaphragm 371 of the variable mechanism 37 is displaced, more easily than the diaphragm of the speaker unit 31 and a diaphragm of the drone cone 32, in accordance with the pressure variation of the direct current component.

Furthermore, the resonance frequency f37 of the variable mechanism 37 is required to be set so as to be lower than the resonance frequency f31 of the speaker unit 31 and the resonance frequency f32 of the drone cone 32. Thus, the vibration of the variable mechanism 37 is suppressed in the reproduction frequency ranges of the speaker unit 31 and the drone cone 32. As a result, it becomes possible to allow the variable mechanism 37 not to emit the undesirable sound in the reproduction frequency ranges of the speaker unit 31 and the drone cone 32. In the general speaker system, the resonance frequency f31 of the speaker unit 31 is higher than the resonance frequency f32 of the drone cone 32. Furthermore, the resonance frequency f32 of the drone cone 32 is in the vicinity of 50 Hz. Thus, if the resonance frequency f37 of the variable mechanism 37 is set to be lower than the resonance frequency f32 (e.g., 20 Hz or less), the variable mechanism 37 can be operated separately from the speaker unit 31 and the drone cone 32.

As described above, as shown in FIG. 6, in the phase inversion type speaker system including the drone cone 32, the area of the diaphragm 371 of the variable mechanism 37 and the stiffness of the suspension 372 of the variable mechanism 37 are set, respectively, so as to satisfy a condition that the resonance frequency f37 of the variable mechanism 37 be lower than the resonance frequency f31 of the speaker unit 31 and the resonance frequency f32 of the drone cone 32, and to satisfy the above equations (10) and (11). Therefore, when the pressure variation of the direct current component occurs in the chamber R31, the diaphragm 371 of the variable mechanism 37 is more easily displaced than the diaphragm of the speaker unit 31 and the diaphragm of the drone cone 32. In other words, even if the pressure in the chamber R31 varies in accordance with variations in ambient temperature or atmospheric pressure of the speaker system, a direct influence exerted on the speaker unit 31 and the drone cone 32 is suppressed. As a result, each of positions of the diaphragms of the speaker unit 31 and the drone corn 32 is not to be deviated from a normal equilibrium position, thereby making it possible to ensure a stable operation. Furthermore, the resonance frequency f37 of the variable mechanism 37 is lower than the resonance frequency f31 of the speaker unit 31 and the resonance frequency f32 of the drone cone 32, thereby suppressing the vibration produced by the variable mechanism 37 in the reproduction frequency ranges of the speaker unit 31 and the drone cone 32. As a result, it becomes possible to allow the variable mechanism 37 not to emit the undesirable sound in the reproduction frequency range of the speaker unit 31.

The speaker system according to the aforementioned first to third embodiments is mounted in an audiovisual system, for example. As an example, the speaker system according to the. aforementioned first to third embodiments is mounted in a television (e.g., a cathode-ray tube television, a liquid crystal television, a plasma television, or the like).

Figure 7:
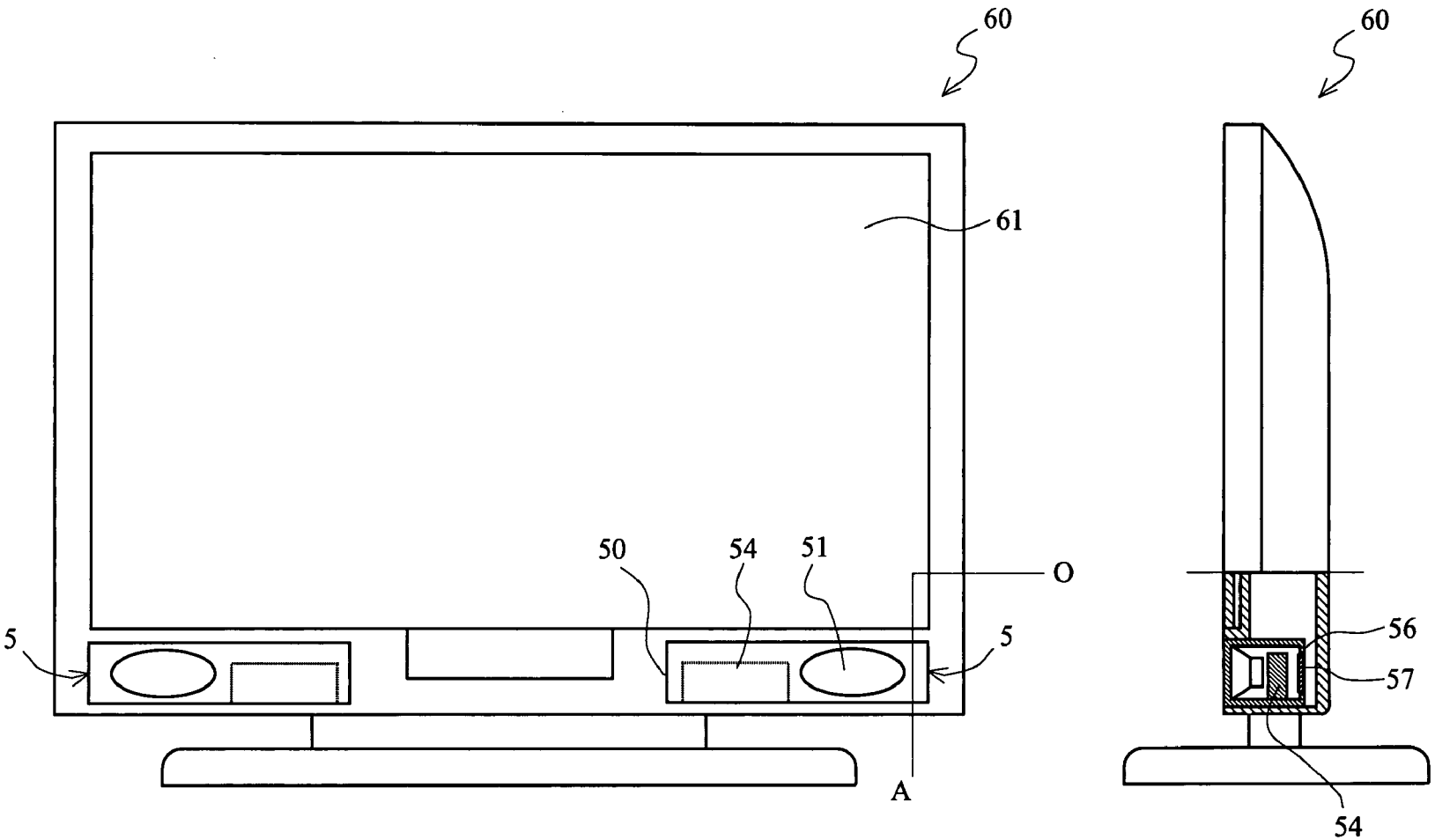
[FIG. 7]

FIG. 7 is a view illustrating an exemplary structure in which the aforementioned speaker system is mounted in a slim television. FIG. 7 includes a front view of the slim television and a side view of the slim television showing a cross-sectional view of a portion of the slim television, along lines OA of the front view. In FIG. 7, the slim television includes a slim television body 60, a display 61, two speaker systems 5. The speaker systems 5 are the speaker systems described in the first to third embodiments, and may be any speaker system in the above embodiments. In the present embodiment, it is assumed that each speaker system 5 includes a cabinet 50, a speaker unit 51, an adsorption member 54, a backboard 56 and a variable mechanism 57, and is the speaker system described in the third embodiment.

The cabinet 50 of the speaker system 5 is embedded in the lower part of the display 61. The speaker unit 51 is a speaker unit, for example, having an elliptical shape, and mounted in the cabinet 50. Each structure of the adsorption member 54 and the variable mechanism 57 has the same function as the respective structures described in the third embodiment. Thus, detailed descriptions thereof are omitted here. As described above, by mounting the speaker system according to the present invention in the slim television 60, it becomes possible to realize the slim television 60 capable of extending a bass reproduction range even if a cabinet volume is the same as that of a conventional speaker system.

Furthermore, when the slim television 60 can obtain the same level of the bass reproduction range as that of the conventional speaker system, the size of each cabinet 55 of each speaker system 5 can be smaller than that of the conventional speaker system. Therefore, in the case where a problem lies in a space for mounting the speaker system when the size or the thickness of the slim television 60 is further reduced, the size or the thickness of the slim television 60 can be reduced by mounting the speaker systems 5 in the slim television. Although the present embodiment illustrates an example where the cabinets 50 of the speaker systems 5 shown in FIG. 7 are mounted in the lower part of the display 61, the cabinets 50 may be arranged on right and left sides of the display 61, respectively.

Figure 8:
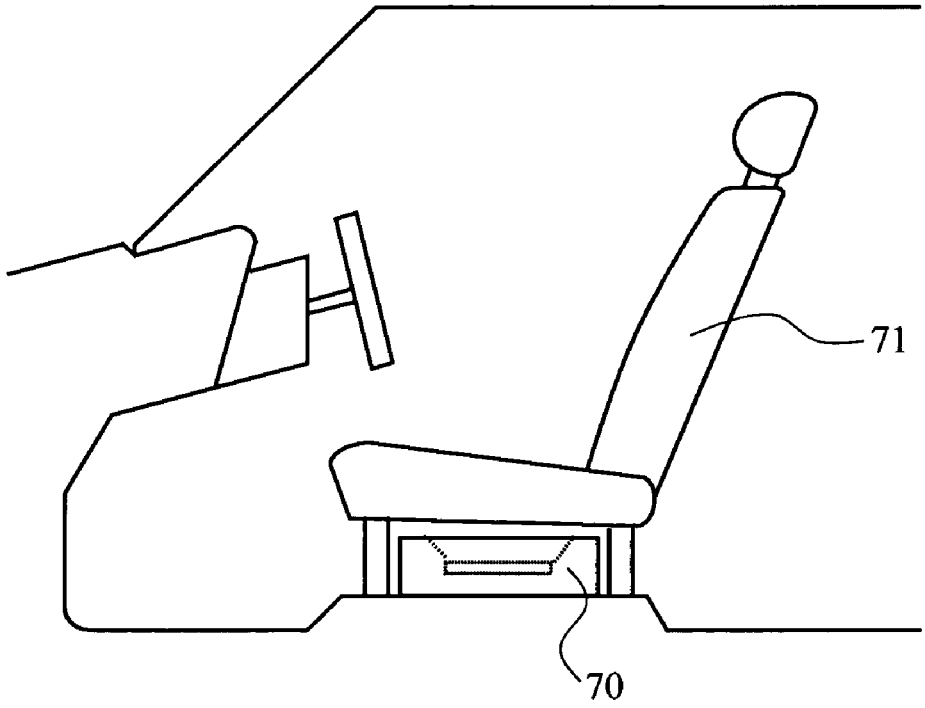
[FIG. 8]
Figure 9:
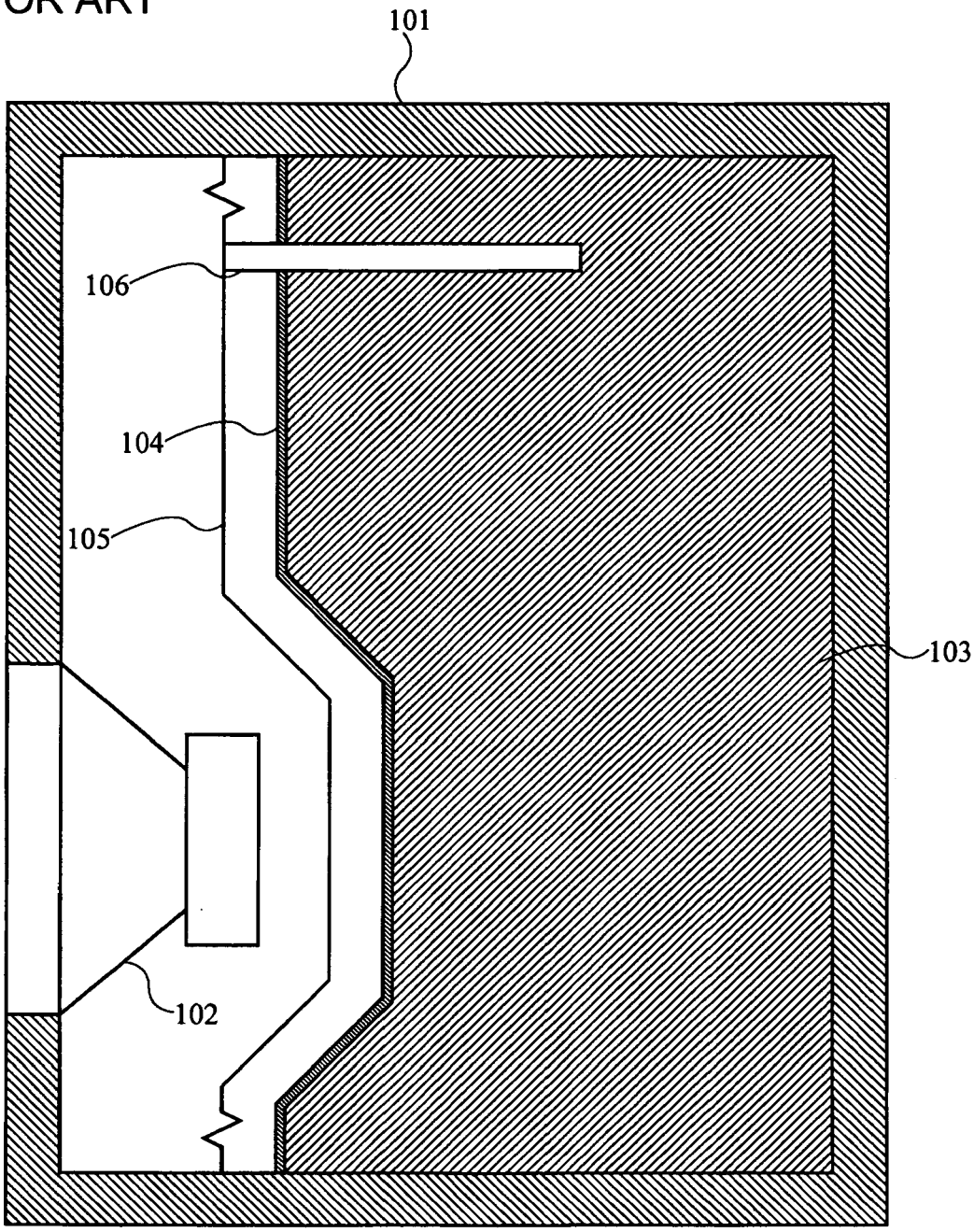
FIG. 9 PRIOR ART
[FIG. 9]

Alternatively, the speaker system according to the aforementioned first to third embodiments may be a speaker system for a vehicle, for example. FIG. 8 is a view illustrating an exemplary structure in which the speaker system is mounted in a vehicle. In FIG. 8, a speaker system 70 is mounted under a vehicle seat 71, for example. The speaker system 70 is any speaker system according to the aforementioned first to third embodiments, and a detailed description thereof is omitted here. As described above, by mounting the speaker system 70 in the vehicle, it becomes possible to provide an in-vehicle listening environment capable of expanding a bass reproduction range even if a cabinet volume is the same as that of a conventional speaker system.

A temperature in the vehicle is more likely to be higher than that in a house or the like. Even under such a temperature condition, the speaker system 70 is operable to reduce a pressure increase as compared to a conventional speaker system using an adsorption member, thereby maintaining an acoustic performance. Therefore, it is particularity effective to employ the speaker system 70 as a speaker system for a vehicle which is exposed to a high temperature.

When the same level of the bass reproduction range as that of the conventional speaker system can be obtained, the size of the cabinet of the speaker system 70 can be smaller than that of the cabinet of the conventional speaker system. Therefore, with the speaker system 70 mounted in the vehicle, more space can be saved therein. Furthermore, in a woofer such as a sub woofer, it is particularity effective since the woofer generally requires a large volume cabinet.

INDUSTRIAL APPLICABILITY

A speaker system according to the present invention is capable of implementing satisfactory bass reproduction even with a small cabinet volume, and is applicable to a liquid crystal television, a PDP (a plasma display), a stereo device, a 5.1 channel home theater speaker, a speaker for a vehicle, and the like.

The invention claimed is:

1. A speaker system comprising:

a cabinet in which a sealed chamber sealed from outside air is formed in at least a portion of an interior chamber of the cabinet;

a speaker unit provided in a first opening formed in the cabinet;

an adsorption member, disposed in the sealed chamber of the cabinet, for physically adsorbing gas in the sealed chamber; and a variable mechanism, provided in a second opening, different from the first opening, formed in the cabinet, for varying a volume of the sealed chamber of the cabinet in accordance with at least a pressure variation of a direct current component, the pressure variation occurring in the sealed chamber, wherein the variable mechanism includes a plate member, and a supporting member, fixed on the second opening, for supporting the plate member such that the plate member is capable of being displaced in a direction in which the volume of the sealed chamber increases or decreases, wherein the interior chamber of the cabinet is formed only by the sealed chamber, wherein the plate member of the variable mechanism is displaced, more easily than a diaphragm of the speaker unit, in accordance with at least the pressure variation of the direct current component, the pressure variation occurring in the sealed chamber, in the direction in which the volume of the sealed chamber increases or decreases, and wherein a resonance frequency of the variable mechanism is lower than that of the speaker unit.

2. The speaker system according to claim 1, wherein the adsorption member is a porous material.

3. The speaker system according to claim 1, wherein the adsorption member is activated carbon.

4. The speaker system according to claim 1, further comprising a drone cone provided in a third opening, different from the first and the second openings, formed in the cabinet, wherein the plate member of the variable mechanism is displaced, more easily than a diaphragm of the drone cone, in accordance with at least the pressure variation of the direct current component, the pressure variation occurring in the sealed chamber, in the direction in which the volume of the sealed chamber increases or decreases, and the resonance frequency of the variable mechanism is lower than that of the drone cone.

5. A speaker system comprising:

a cabinet in which a sealed chamber sealed from outside air is formed in at least a portion of an interior chamber of the cabinet;

a speaker unit provided in a first opening formed in the cabinet;

an adsorption member, disposed in the sealed chamber of the cabinet, for physically adsorbing gas in the sealed chamber; and a variable mechanism, provided in a second opening, different from the first opening, formed in the cabinet, for varying a volume of the sealed chamber of the cabinet in accordance with at least a pressure variation of a direct current component, the pressure variation occurring in the sealed chamber, wherein the variable mechanism includes a plate member, and a supporting member, fixed on the second opening, for supporting the plate member such that the plate member is capable of being displaced in a direction in which the volume of the sealed chamber increases or decreases, wherein the variable mechanism further includes a first parting board for separating the sealed chamber into a first chamber in which the adsorption member is disposed, and a second chamber contacting the plate member and the supporting member, wherein a sound hole for passing air between the first chamber and the second chamber is formed through the first parting board, and wherein the sound hole functions as a lowpass filter having a cut-off frequency lower than a frequency of a bass reproduction limit of the speaker unit.

6. The speaker system according to claim 5, wherein the interior chamber of the cabinet is formed only by the sealed chamber separated into the first and the second chambers, and the plate member of the variable mechanism is displaced, more easily than a diaphragm of the speaker unit, in accordance with at least the pressure variation of the direct current component, the pressure variation occurring in the sealed chamber, in the direction in which the volume of the sealed chamber increases or decreases.

7. The speaker system according to claim 6, further comprising a drone cone, contacting the first chamber, provided in a third opening, different from the first and the second openings, formed in the cabinet, wherein the plate member of the variable mechanism is displaced, more easily than a diaphragm of the drone cone, in accordance with at least the pressure variation of the direct current component, the pressure variation occurring in the sealed chamber, in the direction in which the volume of the sealed chamber increases or decreases.

8. The speaker system according to claim 5 further comprising:

a second parting board for separating the first chamber from a third chamber, contacting the speaker unit, which is not included in the sealed chamber;

a transmission mechanism, provided in an opening formed through the second parting board, for transmitting a pressure variation in the third chamber in a reproduction frequency range of the speaker unit to the first chamber; and a port, provided in the cabinet, for exposing the third chamber to an exterior of the cabinet, wherein the transmission mechanism includes a diaphragm, and a suspension, fixed on the opening formed through the second parting board, for supporting the diaphragm such that the diaphragm is capable of being vibrated in accordance with a reproduction sound pressure of the speaker unit, and the plate member of the variable mechanism is displaced, more easily than the diaphragm of the transmission mechanism, in accordance with at least the pressure variations of the direct current component, the pressure variations occurring in the first and second chambers, in a direction in which the volume of the sealed chamber formed by the first and second chambers increases or decreases.

9. The speaker system according to claim 8, wherein an area of the plate member of the variable mechanism is larger than that of the diaphragm of the transmission mechanism.

10. The speaker system according to claim 8, wherein a stiffness of the supporting member of the variable mechanism is smaller than that of the suspension of the transmission mechanism.

11. The speaker system according to claim 5, wherein the adsorption member is a porous material.

12. The speaker system according to claim 5, wherein the adsorption member is activated carbon.

* * * * *

UNITED STATES PATENT AND TRADEMARK OFFICE

CERTIFICATE OF CORRECTION

PATENT NO. : 7,477,755 B2
APPLICATION NO. : 10/583323
DATED : January 13, 2009
INVENTOR(S) : Shuji Saiki et al.

It is certified that error appears in the above-identified patent and that said Letters Patent is hereby corrected as shown below:

On the Title Page

Item (56), Other Publications, line 12, "65(6)" should read --65(5)--.

Signed and Sealed this

Twenty-first Day of July, 2009

JOHN DOLL
*Acting Director of the United States Patent and Trademark Office*